US010644440B2

(12) United States Patent
Sugimoto et al.

(10) Patent No.: US 10,644,440 B2
(45) Date of Patent: May 5, 2020

(54) CONNECTOR COVER

(71) Applicant: Sumitomo Wiring Systems, Ltd., Yokkaichi, Mie (JP)

(72) Inventors: Yuki Sugimoto, Mie (JP); Yoshitsugu Hirayama, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/291,233

(22) Filed: Mar. 4, 2019

(65) Prior Publication Data

US 2019/0288444 A1 Sep. 19, 2019

(30) Foreign Application Priority Data

Mar. 13, 2018 (JP) ..... 2018-044932

(51) Int. Cl.
*H01R 13/58* (2006.01)
*H01R 13/506* (2006.01)

(52) U.S. Cl.
CPC ..... *H01R 13/5812* (2013.01); *H01R 13/506* (2013.01); *H01R 13/582* (2013.01); *Y10S 439/906* (2013.01)

(58) Field of Classification Search
CPC ..... H01R 13/5812; H01R 13/5804; H01R 13/582; H01R 13/506; H01R 13/502; Y10S 439/906
See application file for complete search history.

(56) References Cited

U.S. PATENT DOCUMENTS 4,606,596 A * 8/1986 Whiting ..... H01R 13/58 439/465
7,713,081 B2 * 5/2010 Chen ..... H01R 9/037 439/409
7,806,717 B2 * 10/2010 Nakano ..... H01R 13/5833 439/367
9,017,109 B2 * 4/2015 Gotou ..... H01R 13/518 439/718
10,249,976 B1 * 4/2019 Thomas ..... H01R 13/582
2016/0352039 A1 * 12/2016 Yamaki ..... H01R 13/506

FOREIGN PATENT DOCUMENTS

JP 2007-250397 9/2007

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A connector cover (1) for protecting a wire (80) extending rearward from a connector (100) includes a cover body (10) mountable to extend rearwardly of the connector (100) and fixed to the connector (100), a rear cover (50) disposed behind the cover body (10), a coupling (70) coupling the rear cover (50) and the cover body (10), and extending shape holding portions (60) capable of holding the rear cover (50) in a rearward extending state to extend rearwardly of the connector (100). The rear cover (50) transitions to a rearward extension released state where the rearward extending state is released by being laterally pushed by the wire (80).

6 Claims, 16 Drawing Sheets

CONNECTOR COVER

BACKGROUND

Field of the Invention

This specification relates to a connector cover.

Related Art

Japanese Unexamined Patent Publication No. 2007-250397 discloses a connector with a housing and a wire cover for surrounding a wire pulled out from the rear surface of a housing. The wire cover includes two base portions having a halved shape and mounted on the housing from opposite sides, and two cover bodies having a halved shape and to be mounted on the base portions from opposite sides. A locking projection on one of the cover bodies and a locking piece on the other are locked to each other with the cover bodies fit on rotary shafts provided on the base portions from the opposite sides. Thus, the cover bodies are supported rotatably about the rotary shafts with respect to the base portions.

Engaging claws are provided on side walls of the base portions, and contact portions are provided on both side parts of the cover bodies. If a mating connecting portion is disposed at a position deviated from an axis of the housing, the contact portions are engaged with the engaging claws, and the cover bodies are rotated with respect to the base portions. In this way, the wire pulled from the rear surface of the housing can be pulled out in a direction corresponding to the disposed position of the mating connecting portion.

In this known connector, the wire pulled out from the rotated cover bodies may be bent further, and an excessive bending force applied to the cover bodies may be transferred to the base portions. Thus, locking parts of the base portions and the housing may be break.

SUMMARY

The invention relates to a connector cover for protecting a wire extending rearward from a connector. The connector cover includes a cover body fixed to the connector and mountable to extend rearwardly of the connector. A rear cover is disposed behind the cover body, and a coupling portion couples the rear cover and the cover body. An extending shape holding portion is capable of holding the rear cover in a rearward extending state to extend rearwardly of the connector. The rear cover transitions to a rearward extension released state where the rearward extending state is released by being pushed laterally by the wire.

According to this configuration, the rear cover extends rearward of the connector in the rearward extending state. Thus, the connector cover can be made longer by the length of the rear cover. In this way, the connector can be inserted to a back side of a narrow space while the rear cover is held, for example, at the time of connection to a mating connector arranged on the back side of the narrow space. Therefore, work efficiency is good.

The wire may be bent into contact with the rear cover. Thus, a force for rotationally displacing the connector cover acts with the rear cover as a point of force and with a mounted position of the cover body on the connector as a fulcrum acts on the connector cover. At this time, a rear cover that is kept in the rearward extending state to extend rearward of the connector easily causes detachment of the connector cover from the connector since a load acting on the fulcrum increases by the principle of leverage due to a rearward extending length of the connector. In contrast, according to the subject invention, the rear cover transitions to the rearward extension released state where the rearward extending state is released by being pushed by the wire. Thus, the connector cover becomes shorter and an increase of the load acting on the fulcrum is suppressed. In this way, the detachment of the connector cover from the connector can be prevented.

Further, the rear cover is coupled to the cover body by the coupling portion. Thus, the detachment of the rear cover from the cover body can be prevented when the rearward extending state is released.

The cover body may include a locking portion to be locked to the connector with a predetermined locking force. Additionally, a holding force of the extending shape holding portion to hold the rear cover in the rearward extending state is smaller than a pressing force of the wire to press the rear cover, and the predetermined locking force is larger than a load generated in the locking portion by the pressing force. According to this configuration, the pressing force of the wire to press the rear cover exceeds the holding force of the extending state holding portion to release the rearward extending state. Thus, the cover body is kept locked to the connector since the locking force of the locking portion is larger than the load generated in the locking portion by the pressing force. In this way, a locked state of the connector cover to the connector can be maintained reliably.

According to the invention, detachment from the connector can be prevented while work efficiency in connecting the connector in a narrow space is improved.

DETAILED DESCRIPTION

Figure 1:
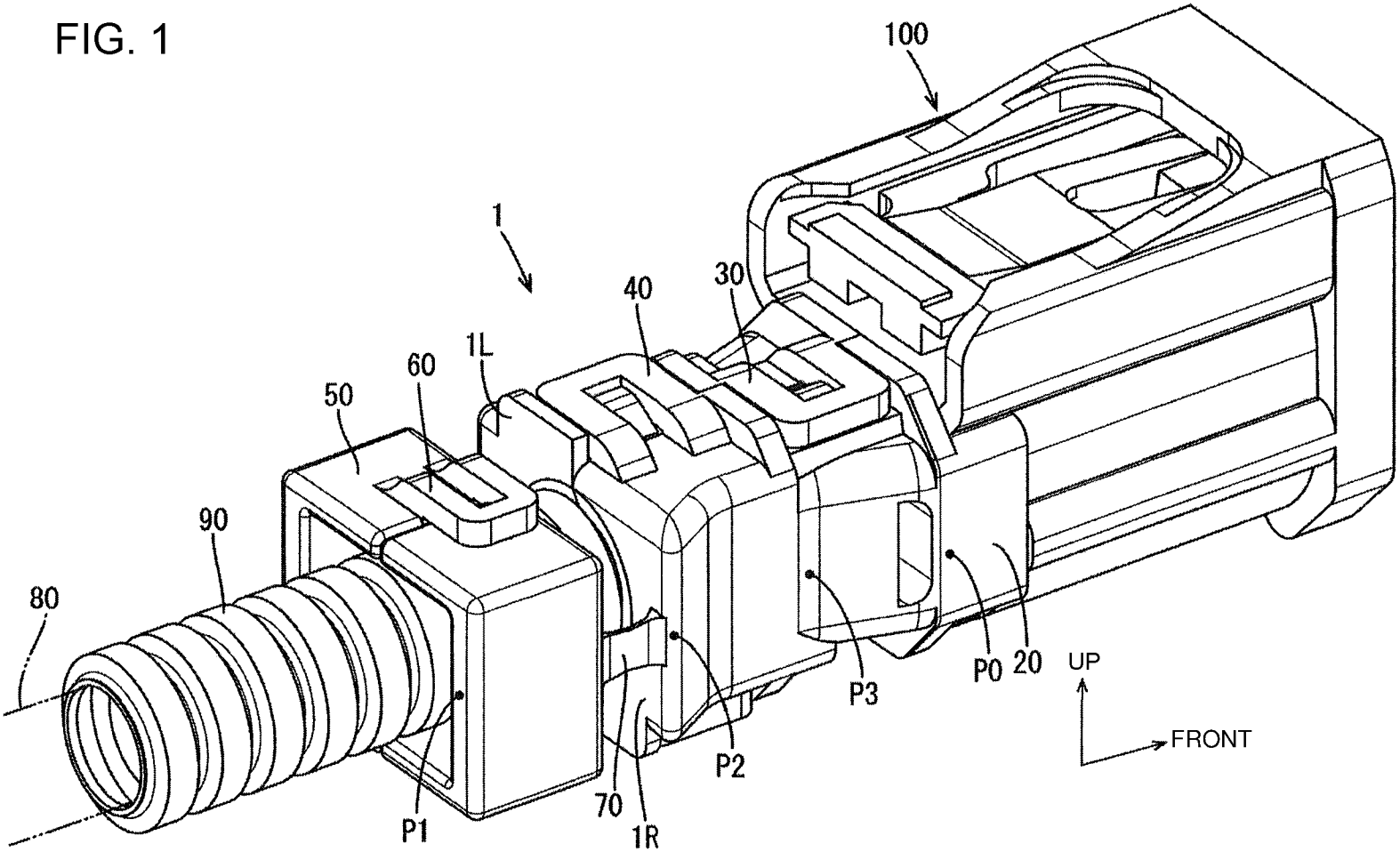
FIG. 1 is a perspective view viewed from behind in a state where a connector cover of an embodiment is mounted on a connector.
Figure 2:
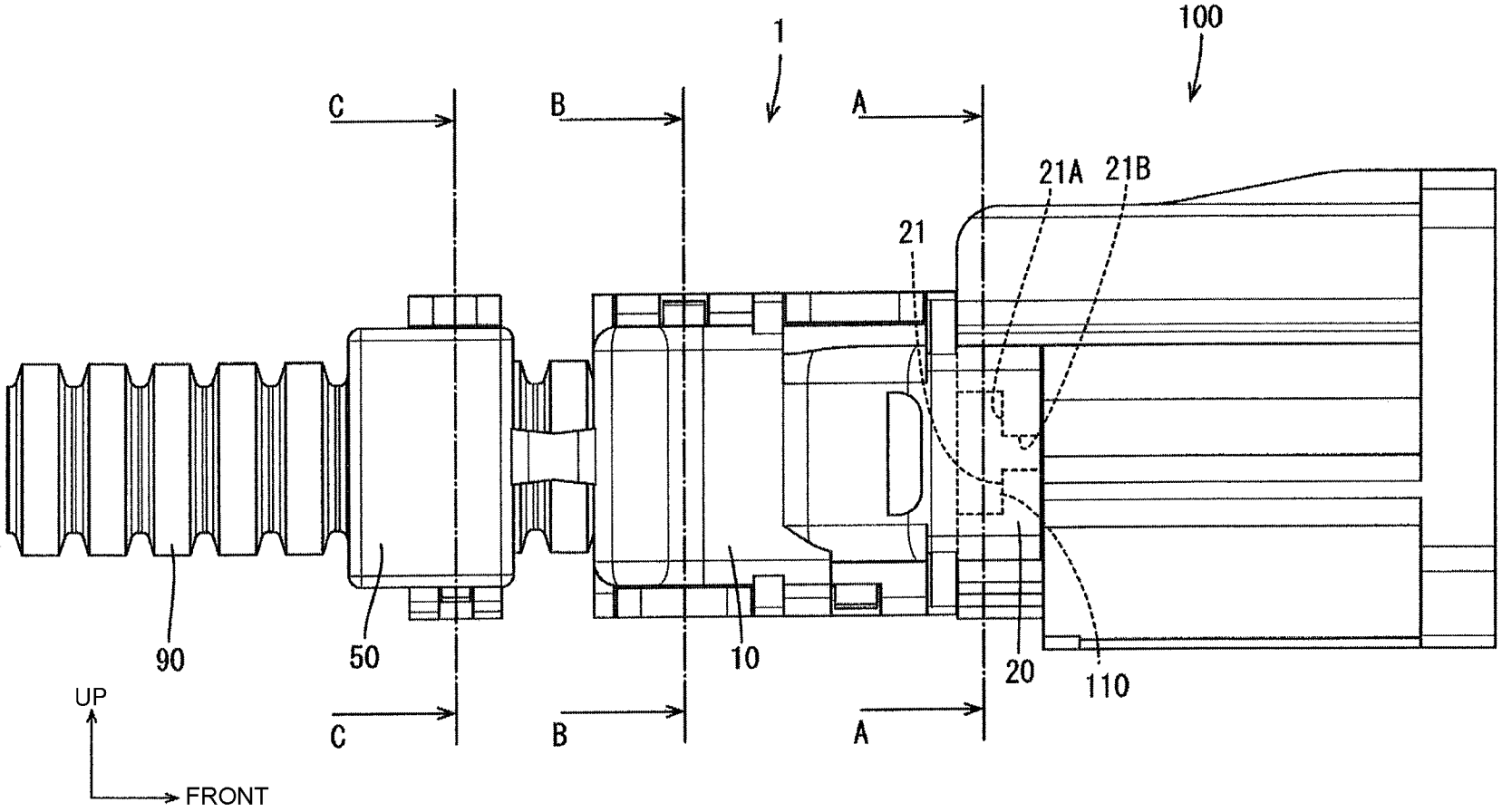
FIG. 2 is a side view in the state where the connector cover is mounted on the connector.

An embodiment is described with reference to FIGS. 1 to 15. A connector cover 1 according to this embodiment is used by being mounted on a connector 100, as shown in FIGS. 1 and 2. In the following description, an upper side in FIG. 1 is referred to as an upper side and a right side in FIG. 2 is referred to as a front side.

Figure 3:
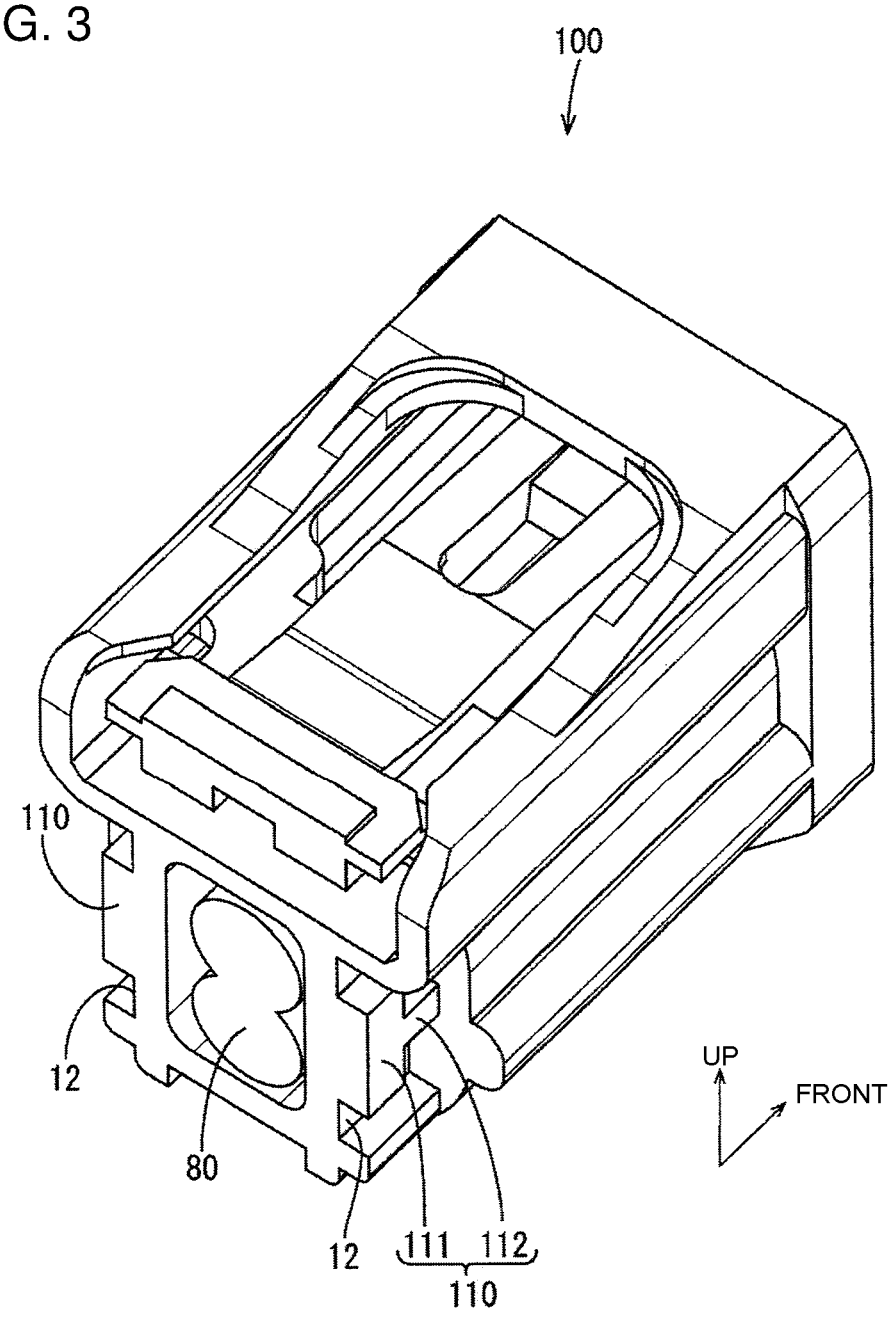
FIG. 3 is a perspective view of the connector.

As shown in FIG. 3, the connector 100 has a rectangular parallelepiped shape extending in a front-rear direction and a wire 80 is pulled out rearward. The connector 100 is connected electrically to a mating connector by fitting a front end to the mating connector.

Left and right mounting receiving portions 110 are provided on the rear end of the connector 100 on which the connector cover 1 is to be mounted. The mounting receiving portions 110 extend laterally from left and right side walls 12 of the connector 100. Each mounting receiving portion 110 includes a retaining ridge 111 extending vertically on the left or right side walls 12 of the connector 100 and a positioning ridge 112 extending forward from a center of the retaining ridge 111 in the front-rear direction.

(Connector Cover 1)

Figure 4:
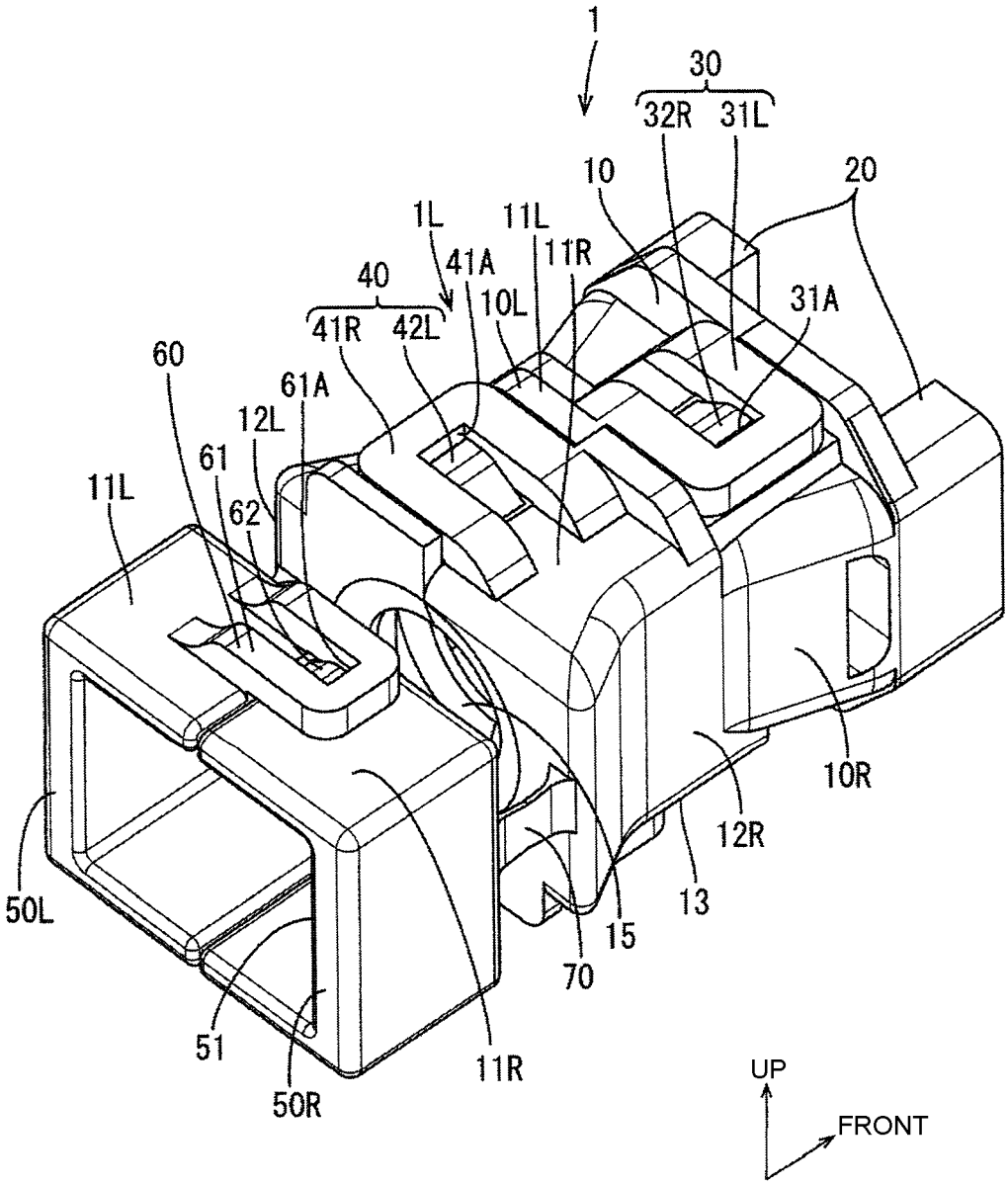
FIG. 4 is a perspective view of the connector cover.

As shown in FIGS. 4 to 7, the connector cover 1 has a tubular shape open in the front-rear direction. As shown in FIG. 4, the connector cover 1 includes a cover body 10 to be mounted on the connector 100, a rear cover 50 provided behind the cover body 10 and a coupling 70 extending between the cover body 10 and the rear cover 50.

(Halved Structure)

Figure 9:
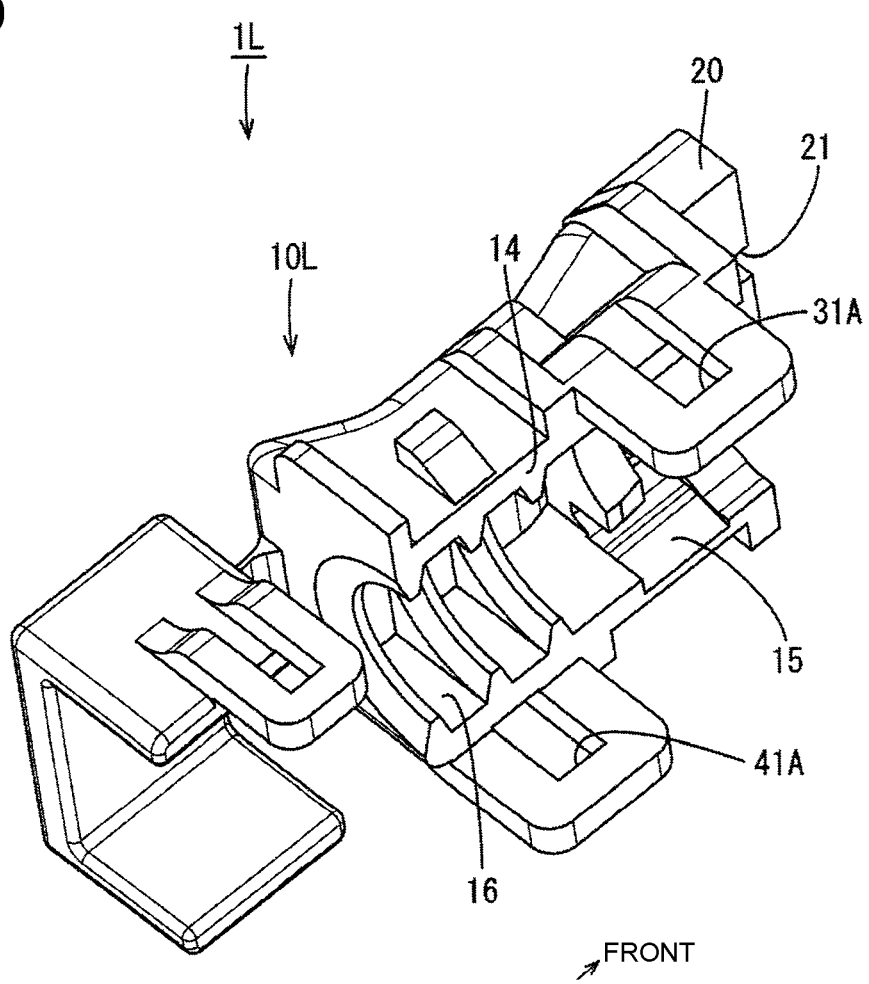
FIG. 9 is a perspective view of the halved member constituting the connector cover.

In particular, the connector cover 1 is formed by locking first and second halved members 1L and 1R each of which has a gutter shape extending in the front-rear direction L. The first and second halved members 1L and 1R have the same shape but are rotated by 180° relative to each other about an axis, as shown in FIG. 9. Parts commonly provided in the first and second halved members 1L, 1R are denoted by reference signs with "L" at the end for the parts of the first halved member 1L and with "R" at the end for the parts of the second halved member 1R. Further, parts common to both the first and second halved members 1L and 1R may be described without attaching "L" or "R".

(Cover Body 10)

The cover body 10 surrounds and protects the wire 80 pulled out from the connector 100 and fix a wire protecting member 90 mounted on the wire 80 to the connector 100, as shown in FIG. 1.

Figure 6:
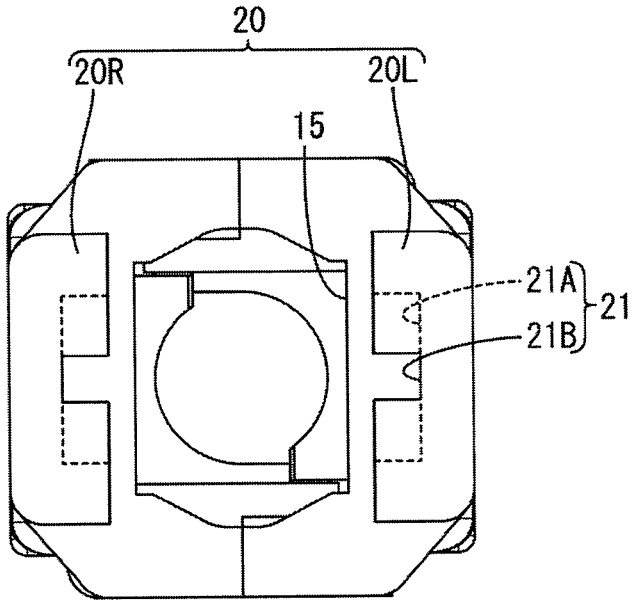
FIG. 6 is a front view of the connector cover.
Figure 7:
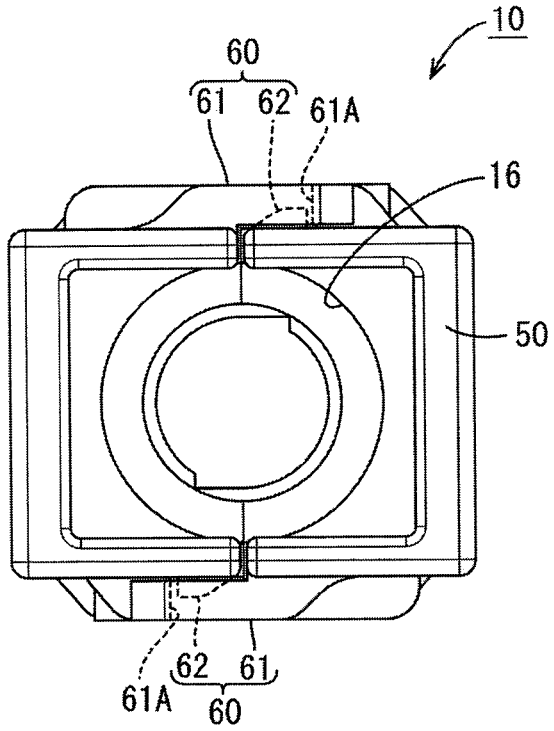
FIG. 7 is a back view of the connector cover.
Figure 8:
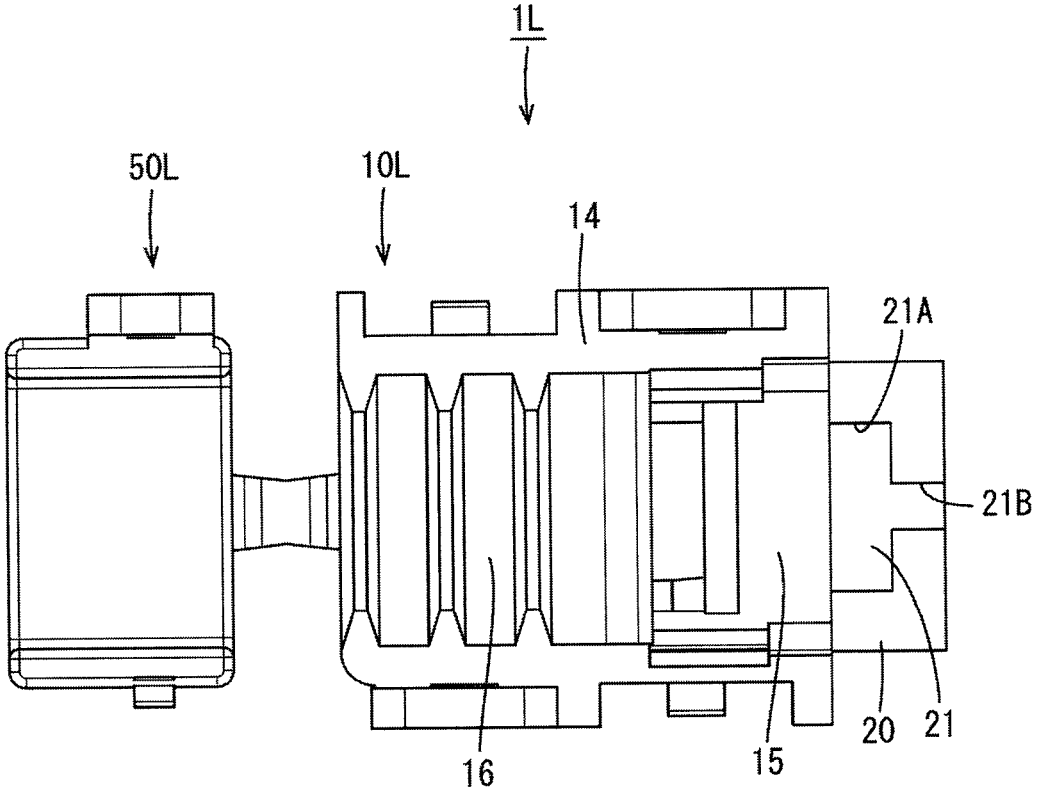
FIG. 8 is a side view of a halved member viewed from a mating surface side.

The cover body 10 has a tubular shape with a ceiling wall 11, left and right side walls 12 and a bottom wall 13 as shown in FIG. 4 and a wire surrounding hole 15 open forward as shown in FIG. 6 and a wire protecting member holding hole 16 open rearward as shown in FIG. 7 are formed inside the cover body 10. As shown in FIGS. 6 and 7, the wire surrounding hole 15 and the wire protecting member holding hole 16 communicate in the front-rear direction. As shown in FIG. 8, the wire protecting member holding hole 16 is in the form of bellows in which large-diameter portions and small-diameter portions are alternately connected from a front end to a rear end, and an inner diameter thereof is slightly smaller than inner diameters of large-diameter portions and small-diameter portions of the wire protecting member 90.

As shown in FIG. 4, left and right mounting portions 20 are on the front end of the cover body 10 and are to be locked to the mounting receiving portion 110 of the connector 100. The mounting portions 20 are formed by extending the left and right side walls 12 of the cover body 10, as shown in FIG. 1, and include mounting recesses 21 to be locked to locking ridges of the connector 100 as shown in FIGS. 2 and 6. Each mounting recess 21 is formed by recessing an inner wall toward an outer wall. Each mounting recess 21 includes a retaining recess 21A in the form of a groove vertically extending, and a positioning recess 21B in the form of a groove extending forward from a center of the retaining recess 21A in the front-rear direction. One mounting portion 20L is provided on the first halved member 1L and the other mounting portion 20 is provided on the second halved member 1R.

As shown in FIG. 4, the body halved portions 10L, 10R of the cover body 10 are at the front ends of the first and second halved members 1L, 1R and are held releasably by upper and lower first locks 30 and a upper and lower second locks 40.

(First Locks 30)

Each of the upper and lower first locks 30 is composed of a first locking piece 31 and a first locking projection 32.

The first locking piece 31L on an upper side is provided on a ceiling wall 11L of the first halved member 1L and has a tongue shape extending along a ceiling wall 11R of the second halved member 1R. The first locking projection 32R on the upper side is provided near an end of a ceiling wall 11R of the second halved member 1R on the side of the first halved member 1L, has a tapered shape whose projecting height increases from the first halved member 1L toward a side wall 12R and projects up.

Figure 5:
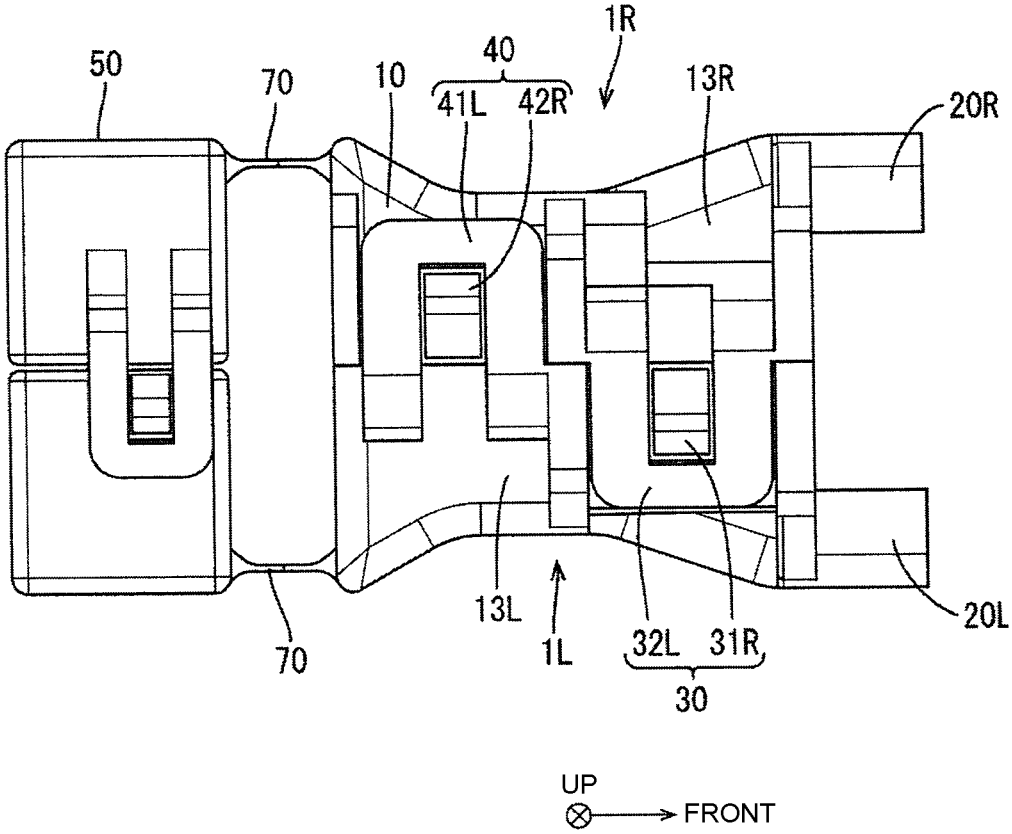
FIG. 5 is a bottom view of the connector cover.

As shown in FIG. 5, the first locking piece 31R on a lower side is provided on a bottom wall 13R of the second halved member 1R and the first locking projection 32L on the lower side is provided on a bottom wall 13L of the first halved member 1L.

As shown in FIGS. 4 and 5, each first lock 30 is locked by the first locking projection 32 being fit into a first locking hole 31A in the first locking piece 31.

(Second Locks 40)

Each of the upper and lower second locks 40 is composed of a second locking piece 41 and a second locking projection 42.

As shown in FIG. 4, the second locking piece 41L on an upper side is provided on the ceiling wall 11R of the second halved member 1R and has a tongue shape extending along the ceiling wall 11L of the first halved member 1L. The second locking projection 42R on the upper side projects up near an end of the ceiling wall 11L of the first halved member 1L on the side of the second halved member 1R, has a tapered shape whose projecting height increases from the second halved member 1R toward a side wall 12L, and projects up.

As shown in FIG. 5, the second locking piece 41L on a lower side is provided on the bottom wall 13L of the first halved member 1L and the second locking projection 42R on the lower side is provided on the bottom wall 13R of the second halved member 1R.

As shown in FIGS. 4 and 5, each second lock 40 is locked by the second locking projection 42 being fit into a second locking hole 41A in the second locking piece 41.

Figure 10:
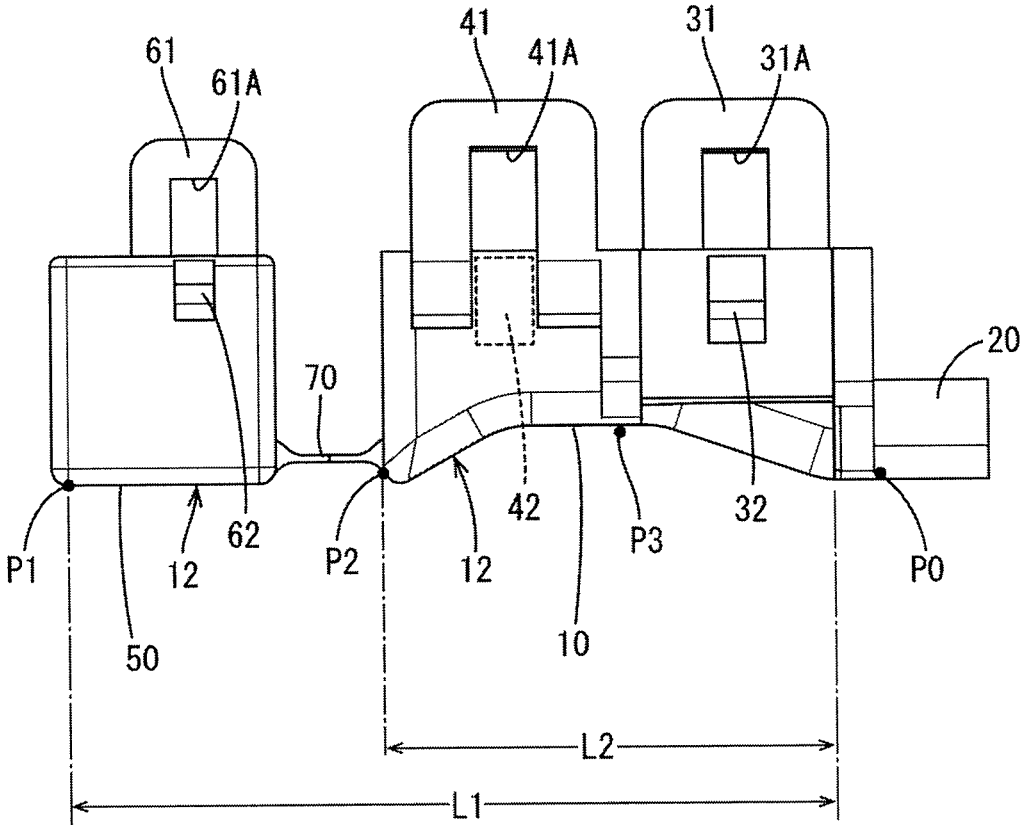
FIG. 10 is a bottom view of the halved member.

As shown in FIG. 10, the second locking piece 41 and the second locking projection 42 respectively have the same shapes and dimensions as the first locking piece 31 and the first locking projection 32 of the first lock 30. In this way, the second lock 40 and the first lock 30 have an equivalent locking force. However, since the second lock 40 is disposed behind the first lock 30, if a lateral pressing force acts on the cover body 10, the second lock 40 receives more pressing force than the first lock 30. Thus, the second and first locks 40, 30 are arranged such that the second lock 40 is unlocked more easily than the first lock 30.

When the second locks 40 are locked, the first and second halved members 1L, 1R are united on a rear end side of the cover body 10 with mating surfaces 14 held in contact with each other, and the wire protecting member 90 is fit into the wire protecting member holding hole 16 inside. In this way, the wire protecting member 90 is fixed to the connector 100 with the expansion and contraction thereof suppressed. The wire 80 pulled out from the connector 100 is pulled out rearward through the wire surrounding hole 15 in the connector cover 1 and the inside of the wire protecting member 90 held in the wire protecting member holding hole 16. In this way, the wire 80 pulled out from the connector 100 is restricted from being bent laterally and is protected from an external force inside the connector cover 1.

(Rear Cover 50)

As described above, the connector cover 1 is mounted to protect the wire 80 pulled out from the connector 100. For example, if an unillustrated mating connector as a connection destination is installed on a back side of a narrow space, a worker may insert the connector 10 to the back side of the narrow space while holding the rear end of the connector cover 1. Considering such use, the entire length of the connector cover 1 is desirably long.

Accordingly, the rear cover 50 is provided behind the cover body 10, and the cover body 10 and the rear cover 50 are coupled by the coupling 70 so that the connector cover 1 is longer by the length of the rear cover 50.

(Coupling 70)

As shown in FIG. 10, the coupling 70 is a thin plate with plate surfaces extending in the front-rear direction, and couples the rear end of the cover body 10 and the front end of the rear cover 50 on each of left and right sides of the connector cover 1. A central part of the coupling 70 in the front-rear direction is thinner than front and rear end parts. In this way, the coupling 70 is laterally deflectable in a center in the front-rear direction.

As shown in FIG. 4, the rear cover 50 is a flat rectangular tube configured such that rear cover halved portions 50L, 50R constituting rear ends of the first and second halved members 1L, 1R. The rear cover halved portions 50L, 50R are U-shaped when viewed from behind and are held releasably by upper and lower extending shape holding portions 60. The inside of the rear cover 50 serves as a wire protecting member surrounding hole 51 penetrating in the front-rear direction. A vertical inner dimension of the wire protecting member surrounding hole 51 is slightly smaller than a diameter of the large-diameter portions of the wire protecting member 90.

Each of the upper and lower extending shape holding portions 60 is provided on a front end of the rear cover 50 and is composed of an extension maintaining piece 61 and an extension maintaining projection 62.

As shown in FIG. 4, the extension maintaining piece 61L on an upper side is provided on the ceiling wall 11L of the first halved member 1L and has a tongue shape projecting along the ceiling wall 11R of the second halved member 1R. The extension maintaining piece 61L is formed with an extension maintaining hole 61AL penetrating in the vertical direction. The extension maintaining projection 62R on the upper side is provided near an end of the ceiling wall 11R of the second halved member 1R on the side of the first halved member 1L and has a tapered shape whose projecting height increases from the first halved member 1L toward the side wall 12R. The extension maintaining piece 61R on the lower side is provided on the second halved member 1R, and the extension maintaining projection 62L on the lower side is provided on the first halved member 1L.

Each extending shape holding portion 60 is locked by the extension maintaining projection 62 being fit into the extension maintaining hole 61A provided in the extension maintaining piece 61.

Dimensions of the extension maintaining piece 61 and the extension maintaining projection 62 are about ½ of those of the second locking piece 41 and the second locking projection 42 of the second lock 40 in the vertical, lateral and front-rear directions, as shown in FIG. 10. In this way, a locking force of the extending shape holding portion 60 is smaller than that of the second lock 40. Together with this, since the extending shape holding portion 60 is disposed behind the second lock 40, if a lateral pressing force acts on the rear cover 50, the extending shape holding portion 60 receives more pressing force than the second lock 40. Thus, the extending shape holding portion 60 and the second lock 40 are arranged such that the extending shape holding portion 60 is unlocked more easily.

(How to Mount Connector Cover 1)

To mount the connector cover 1 on the connector 100, the first and second halved members 1L, 1R are first mounted on the wire 80 pulled out rearward from the connector 100 and the wire protecting member 90 mounted on the wire 80 from opposite sides and the respective first locks 30, the respective second locks 40 and the respective extending shape holding portions 60 are locked while the mounting portions 20 of the cover body 10 are fit laterally to the mounting receiving portions 110 of the connector 100 from left and right sides. In this way, the halved members 1L, 1R are assembled with each other and the connector cover 1 mounted on the connector 100 is completed.

(Locking Maintenance of Connector Cover 1)

Figure 11:
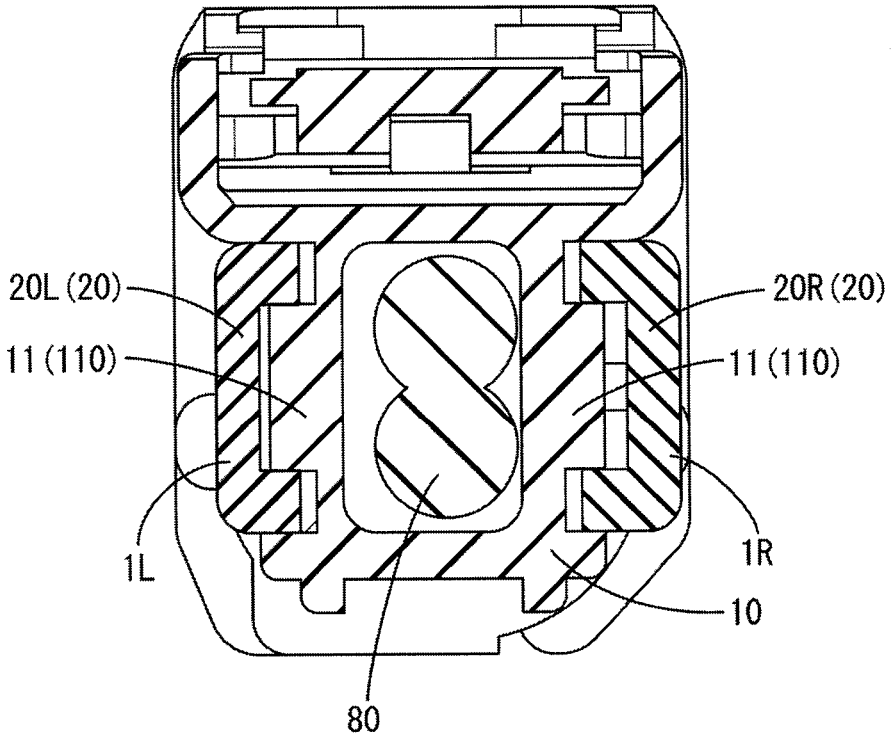
FIG. 11 is a section along A-A of FIG. 2.

In this state, the first and second halved members 1L, 1R are in a locked state where displacements in the lateral direction are restricted by the pair of mounting portions 20 being laterally fit to the pair of mounting portions 110 from outside as shown in FIG. 11 and displacements in the front-rear direction and the vertical direction are restricted by the retaining recesses 21A and the positioning recesses 21B being respectively fit to the retaining ridge portions 111 and the positioning ridge portions 112 as shown in FIG. 2. This locked state is maintained by locking the first locks 30, as described above.

Figure 12:
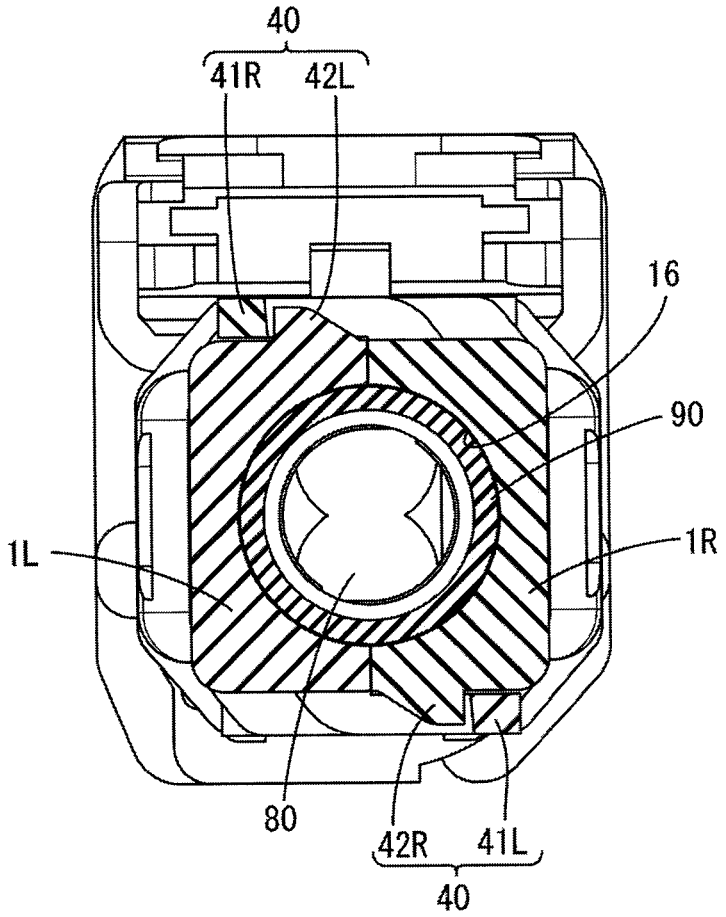
FIG. 12 is a section along B-B of FIG. 2.

The second locks 40 are provided on the outer surface side of the wire protecting member holding hole 16, as shown in FIG. 12, and prevent opening of the wire protecting member holding hole 16. In this way, the wire protecting member 90 is retained and held in the wire protecting member holding hole 16.

Figure 13:
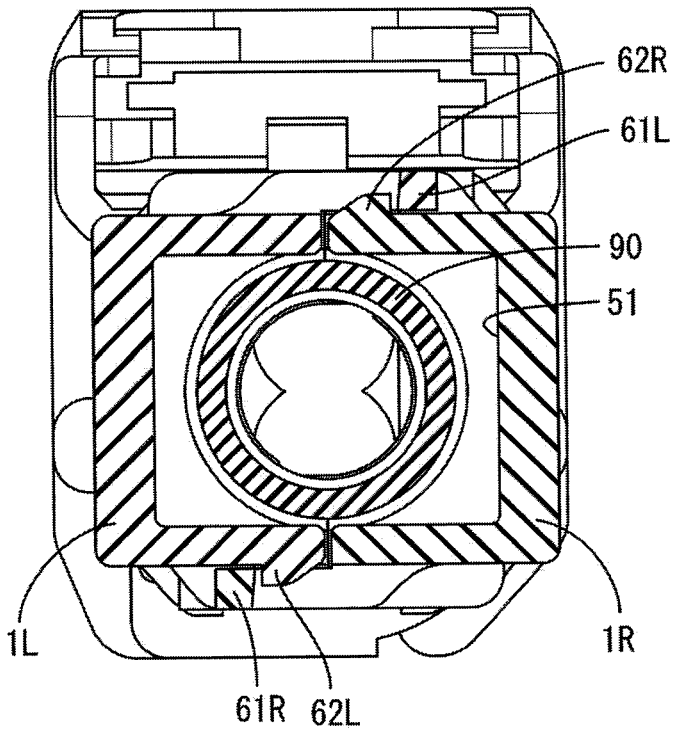
FIG. 13 is a section along C-C of FIG. 2.

The wire protecting member surrounding hole 51 is in contact with the large-diameter portions of the wire protecting member 90 inside the rear cover 50, as shown in FIG. 13. In this way, the wire protecting member 90 is held with clearances formed on left and right sides while being somewhat squeezed in the vertical direction in the wire protecting member surrounding hole 51. This enables the wire protecting member 90 to be displaced in the lateral direction while sliding in contact with the inner surfaces of the ceiling wall 11 and the bottom wall 13.

The connector cover 1 is fixed to the connector 100 while extending rearward of the connector 100, and accommodates the wire 80 pulled out rearward from the connector 100 inside (in particular, between the first and second halved members 1L, 1R). Thus, the worker can connect the connector 100 to the mating connector by holding arbitrary parts of the connector 100 and the connector cover 1 (cover body 10 and rear cover 50).

The locked states of the first locking portions 30, the second locking portions 40 and the extending shape holding portions 60 can be released by lifting a free end of each locking piece up or strongly pulling the locking piece and the locking projection in directions to be laterally separated from each other.

Particularly in a vehicle with a limited space, in the case of connecting the other end side of the wire 80 to a mating device after the connector 100 is connected to a connection destination connector, the mating device is not necessarily arranged at a positon where the wire 80 can be connected without being bent. For example, the mating device may be arranged at a very close position lateral to the connector cover 1 with a connecting direction oriented toward the connector cover 1 and the wire protecting member 90 may be bent at a right angle or larger to orient the tip of the wire 80 in the connecting direction of the mating device. At this time, if the wire protecting member 90 comes into contact with the rear end of the connector cover 1, a load is generated for rotationally displacing the entire connector cover 1 with the rear end as a point of force P1 (see FIG. 1) and the mounting portions 20 as a fulcrum P0 (see FIG. 1).

However, in this embodiment, the rear cover 50 is provided behind the cover body 10 in the connector cover 1, and the connector cover 1 is made longer so that a distance L1 (see FIG. 10) from the point of force to the fulcrum becomes relatively long and the load acting on the fulcrum increases by the principle of leverage. If this load increases a locking force of the mounting portions 20, the connector cover 1 is detached from the connector 100.

Accordingly, in the connector cover 1 of this embodiment, the laterally deflectable coupling 70 is provided between the rear cover 50 and the cover body 10 and the left and right rear cover halved portions 50L, 50R respectively coupled to the cover body 10 by the coupling portion are locked separably from each other to form the rear cover 50. Further, locking forces (holding forces) of the extending shape holding portion 60, the second lock 40 and the first lock 30 are set such that the extending shape holding portion 60, the second lock 40 and the first lock 30 are unlocked in this order.

Figure 14:
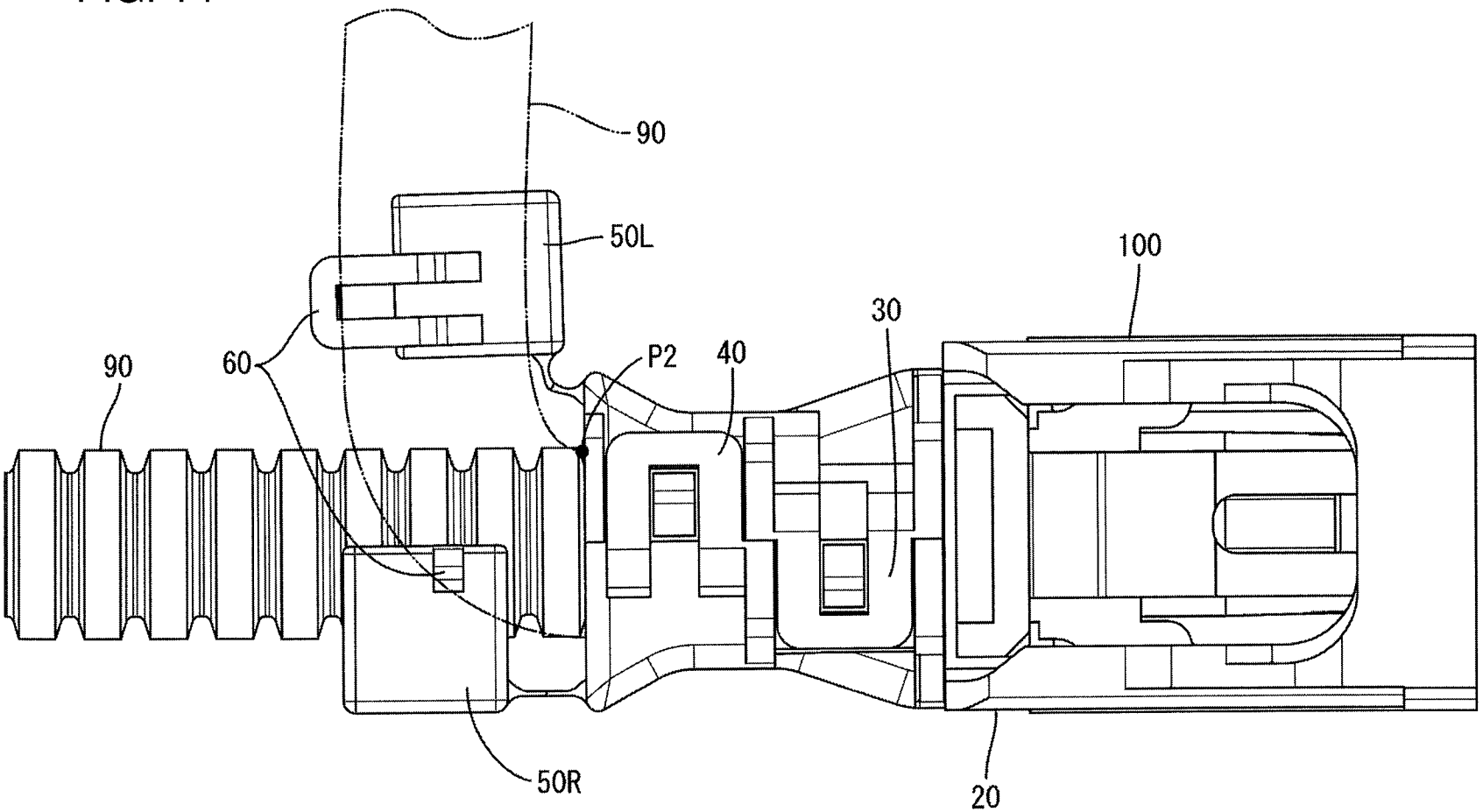
FIG. 14 is a top view showing a state where a rearward extending state is released in one separable portion of a rear cover.

If the wire protecting member 90 is bent laterally and contacts the rear cover 50, the rear cover 50 is first pushed by the wire protecting member 90. At this time, the rear cover halved portion 50R on an unpushed side tries to return to an initial position by a resilient restoring force of the coupling 70, whereas the hand-held halved portion 50L on a pushed side receives a pressing force from the wire protecting member 90. Thus, the extending shape holding portion 60 is pulled laterally to be unlocked. In this way, a rearward extension released state is reached where a rearward extending state of the rear cover 50 is released and, as shown in FIG. 14, the rear cover 50 transitions to a divided state to be divided into two rear cover halved portions 50L, 50R. In the divided state, the rear cover 50 on the pushed side is not rotationally displaceable about a hinge and is retracted to the outside of a moving range of the wire protecting member 90 such as by being successively pushed by the wire protecting member 90.

In this state, a contact point between the wire protecting member 90 and the connector cover 1 moves to the rear end P2 of the cover body 10 (see FIG. 10). In this way, a distance between the fulcrum P0 and the point of force P2 becomes L2 shorter than L1 and an increase of the load at the fulcrum P0 is suppressed.

Also, if the wire protecting member 90 is bent farther, the locked state of the second locking portions 40 is released and the rear end of the cover body 10 is divided. In this way, the point of force further moves to a point P3 (see FIG. 10) or its vicinity and the point of force P3 further approaches the fulcrum P0 to avoid an increase of the load at the fulcrum P0.

Also, if the wire 80 or the wire protecting member 90 is bent beyond the above state, the locked state of the first locking portions 30 is released and the locked state of the mounting portions 20 also is released. In this way, the connector cover 1 is detached from the connector 100. However, since the mounting receiving portions 110 of the connector 100 are released from the load, at least the breakage of the connector 100 can be avoided.

Figure 15:
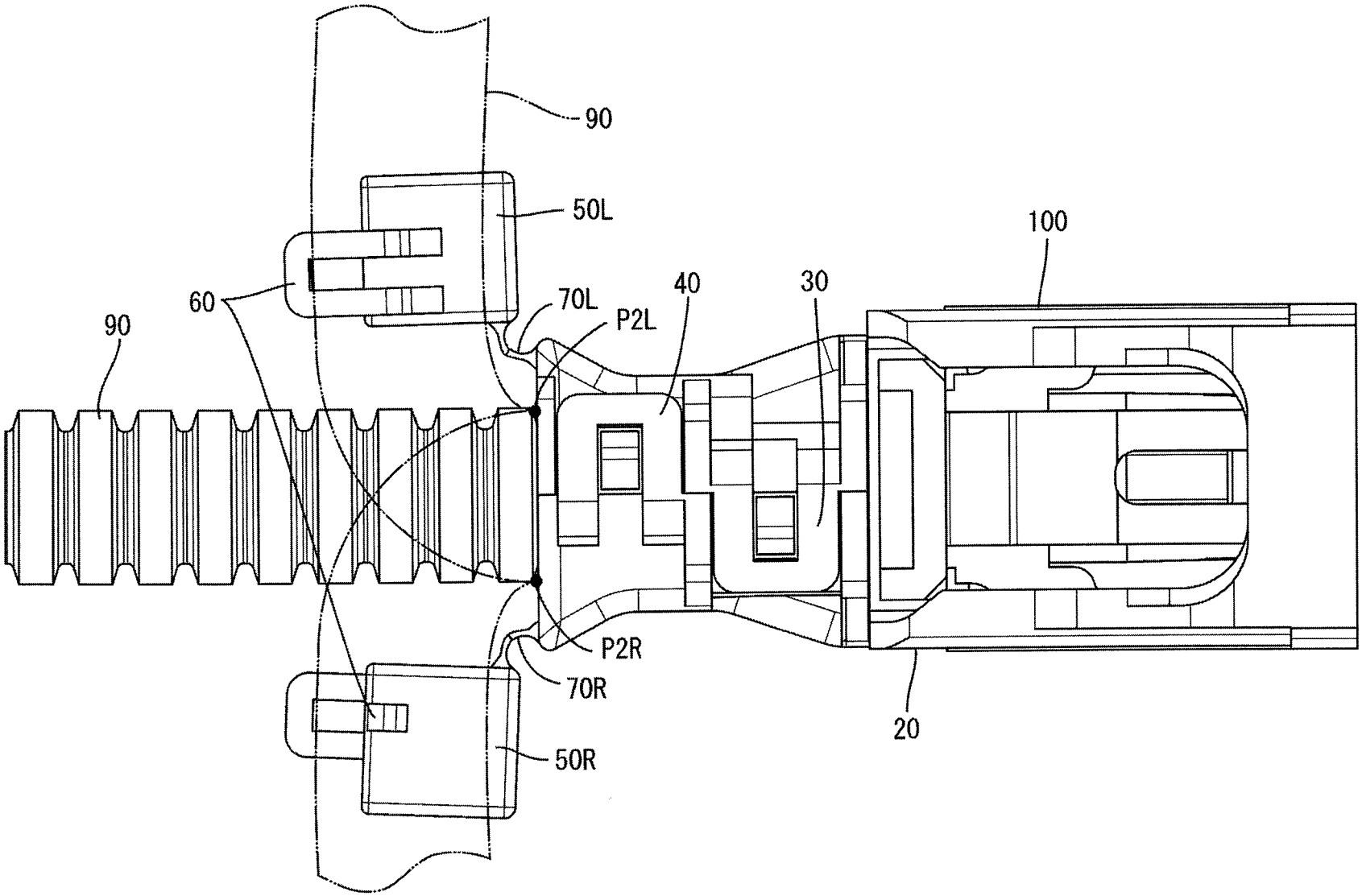
FIG. 15 is a top view showing a state where the rearward extending state is released in both separable portions of the rear cover.

Note that since the rear cover 50 is composed of the respective rear cover halved portions 50L, 50R of the first and second halved members 1L, 1R and these are coupled to the cover body 10 via the coupling 70 in this embodiment, the rear cover 50 can be released from the rearward extending state on both sides of the wire protecting member 90, as shown in FIG. 15. In this way, the cover body 10 is made shorter on the side pushed by the wire protecting member 90 when the wire protecting member 90 pushes the connector cover 1 either leftward or rightward.

(Functions and Effects)

According to the configuration of this embodiment, the connector cover 1 for protecting the wire 80 extending rearward from the connector 100 includes the cover body 10 mountable to extend rearwardly of the connector 100 and fixed to the connector 100, the rear cover 50 disposed behind the cover body 10, the coupling 70 coupling the rear cover 50 and the cover body 10, and the extending shape holding portions 60 capable of holding the rear cover 50 in the rearward extending state to extend rearwardly of the connector 100, and the rear cover 50 transitions to the rearward extension released state where the rearward extending state is released by being laterally pushed by the wire 80.

According to this configuration, the rear cover 50 is shaped to extend rearwardly of the connector 100 in the rearward extending state. Thus, the connector cover 1 can be made longer by the length of the rear cover 50. In this way, for example, at the time of connection to a mating connector arranged on a back side of a narrow space, the connector 100 can be inserted to the back side of the narrow space while the rear cover 60 is held, wherefore workability is good.

Further, if the wire 80 is bent and contacts the rear cover 50, a force acts on the connector cover 1 for rotationally displacing the connector cover 1 with the rear cover 50 as the point of force P1 and the mounted position of the cover body 10 on the connector 10 as the fulcrum P0. At this time, if the rear cover 50 is kept in the state extending rearward of the connector 100, a load acting on the fulcrum P0 due to the length L1 extending rearward of the connector 100 increases by the principle of leverage and easily causes the connector cover 1 to detach from the connector 100. In contrast, in tis embodiment, the rear cover 50 transitions to the rearward extension released state where the rearward extending state is released by being pushed by the wire 80, the connector cover 1 comes to have a shorter length L2. Thus, an increase of the load acting on the fulcrum P0 can be suppressed. In this way, the connector cover 1 will not detach from the connector 100.

Further, the rear cover 50 is coupled to the cover body 10 by the coupling 70. Thus, the cover body 10 will not detach when the rearward extending state is released.

The cover body 10 is provided with the locks for keeping the cover body 10 locked to the connector 100 with a predetermined locking force, the holding force of the extending shape holding portions 60 to hold the rear cover 50 in the rearward extending state is smaller than the pressing force of the wire 80 to press the rear cover 50, and the predetermined locking force is larger than a load generated in the locking portions by the pressing force.

According to this configuration, the pressing force of the wire 80 to press the rear cover 50 exceeds the holding force of the extending shape holding portions 60 to release the rearward extending state, whereas the locking force of the locks is larger than the load generated in the locking portions. Thus, the cover body 10 is kept locked to the connector 100, and the locked state of the connector cover 1 to the connector 100 is maintained.

Other Embodiments

The invention is not limited to the above described and illustrated embodiment. For example, the invention can be embodied as follows.

Although a corrugated tube is mounted as the wire protecting member 90 on the wire 80 and the wire protecting member 90 is held in the second locking hole by the second locking portions 40 in the above embodiment, the wire protecting member 90 may be omitted. In this case, the rear cover is pushed laterally by the wire to be released from the rearward extending state.

Although the cover body 10 is provided with the first locks 30 and the second locks 40 in the above embodiment, the second locks 40 may be omitted.

Although the rear cover 50 is composed of the two rear cover halved portions 50L, 50R in the above embodiment, the rear cover 50 may not be composed of the two rear cover halved portions. For example, a rear cover may be longitudinally divided into three or more pieces, and these pieces may be held in the rearward extending state by being united with each other by extending shape holding portions having the same shape as in the above embodiment. Alternatively, for example, if a wire is possibly bent only in one direction, a rear cover may be formed such that the one of the rear cover halved portions, on a side toward which a wire is possibly not bent, is shaped to be fixed the rear end of the cover body (in other words, a part of the cover body) and the one on a side where the wire is possibly bent is coupled to a cover body by a coupling.

Further, although the extending shape holding portion 60 is composed of the extension maintaining piece 61 and the extension maintaining projection 62 in the above embodiment, the configuration of the extending shape holding portion 60 is not limited to this. For example, a rear cover may be composed of one member having a tubular shape, that tubular member may be provided with a thin breakable portion extending in the front-rear direction, and a rearward extending state is released by the breakable portion being pushed by a wire to be broken. In this case, a connector cover is made shorter by a length of breakage on a side pushed by the wire, and the wire laterally extends through a clearance formed by breakage in the rear cover.

Although the rear end of the cover body 10 and the front end of the rear cover 50 are coupled by the coupling 70 in the above embodiment, the parts of the cover body 10 and the rear cover 50 to be coupled by the coupling 70 are not limited to these. For example, a center of the cover body 10 in the front-rear direction and a center of the rear cover 50 in the front-rear direction may be coupled by a coupling portion.

Related Embodiment

Figure 16:
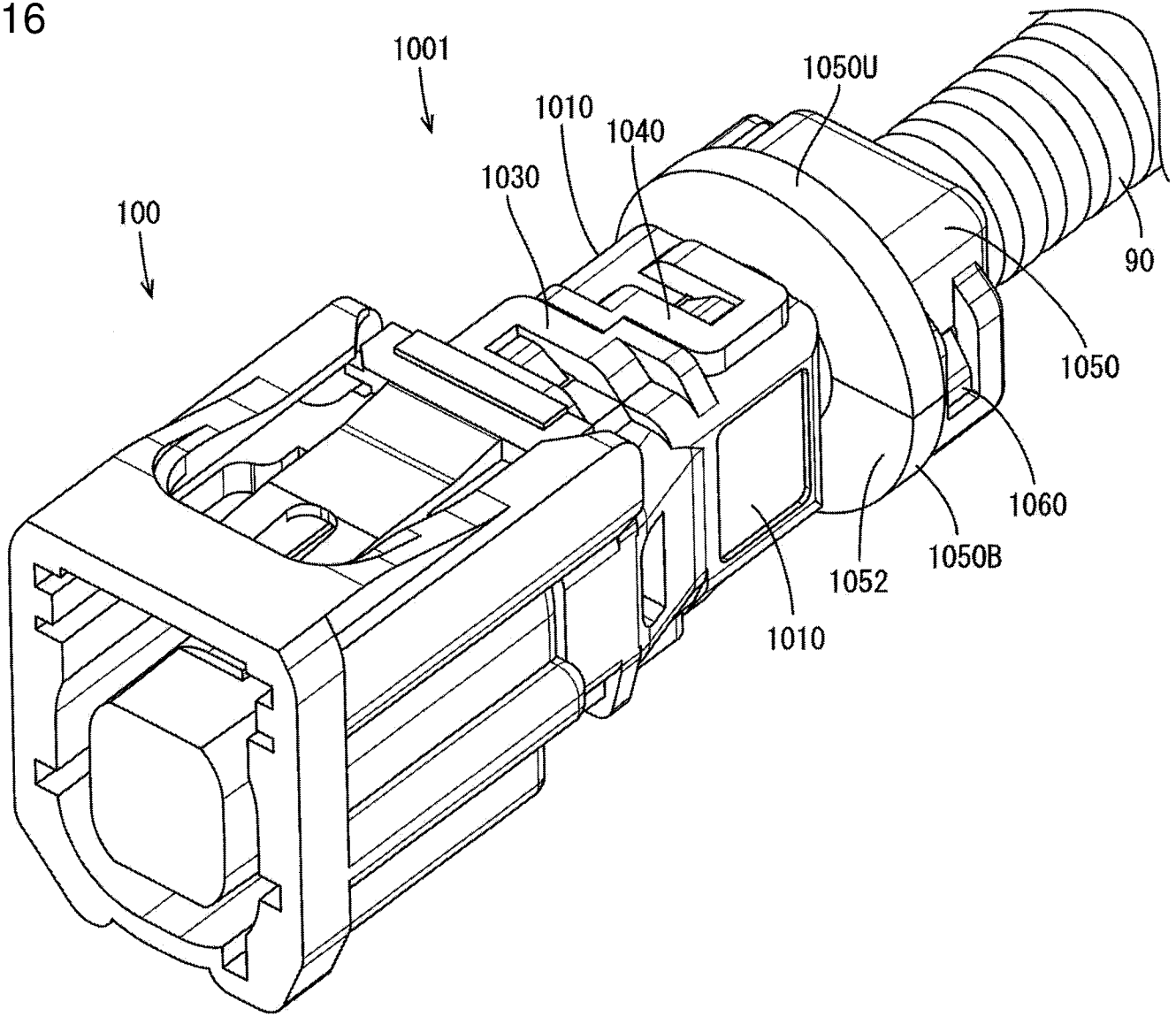
FIG. 16 is a perspective view of a connector cover of a related embodiment.

A related embodiment of the above embodiment is described with reference to FIGS. 16 and 17. In the related embodiment, components corresponding to those of the above embodiment are denoted by the reference signs of the above embodiment plus 1000. The same configuration, functions and effects as in the above embodiment are not described and the same components as in the above embodiment are denoted by the same reference signs.

A connector cover 1001 of this related embodiment differs from the connector cover 1 of the above embodiment by not including any coupling to couple a rear cover 1050 and a cover body 1010. Specifically, the rear cover 1050 is a member independent of the cover body 1010.

The rear cover 1050 is composed of two rear cover halved portions 1050U, 1050B to be mounted on the wire protecting member 90 from opposite sides. The rear cover 1050 includes a flange-like cover body contactable portion 1052 radially extending from a front end. With the connector cover 101 mounted on the connector 100, the rear cover 1050 is mounted on the wire protecting member 90 with the cover body contactable portion 1052 facing or held in contact with the rear end of the cover body 1010.

When a worker performs an operation of connecting the connector 100 to a mating connector in a narrow space, the worker can push the cover body 1010 into the mating connector by holding the rear cover 1050 and bringing the cover body contactable portion 1052 into contact with the rear end of the cover body.

Figure 17:
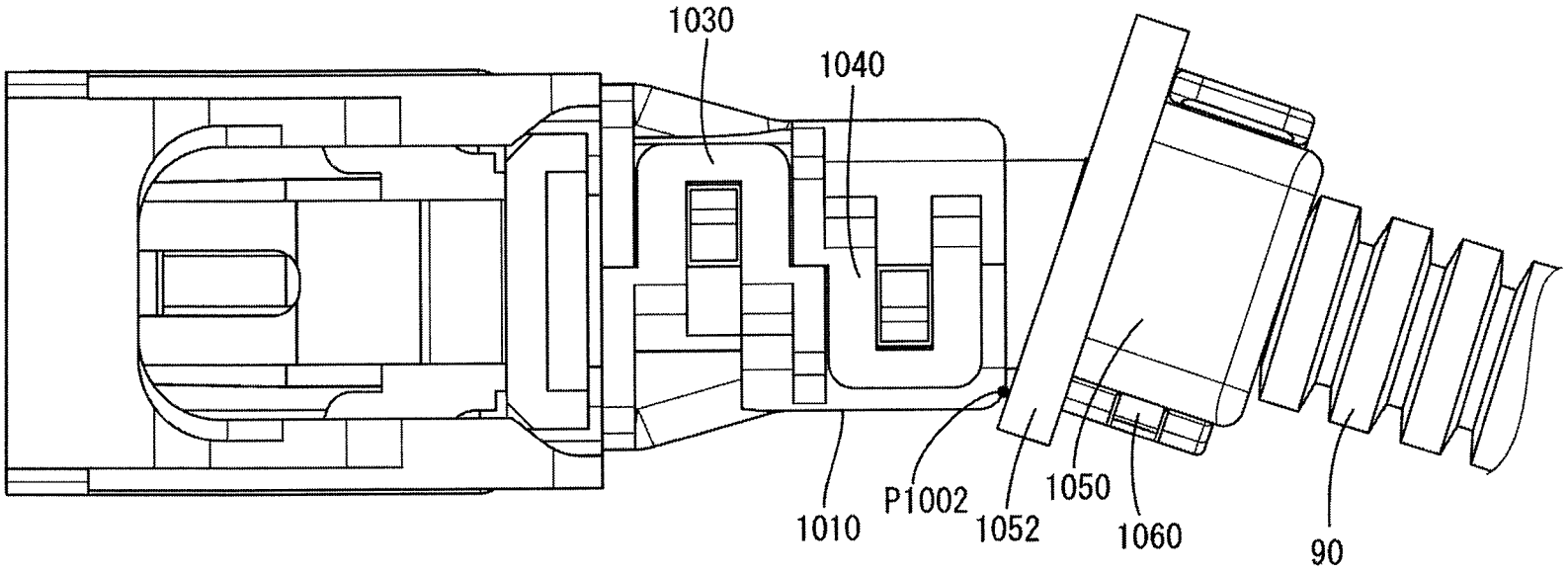
FIG. 17 is a plan view showing a state where the connector cover of the related embodiment is bent.

If the wire protecting member 90 is bent with the connector cover 1001 mounted on the connector 100, the rear cover 1050 is displaced independently of the cover body 1010 as the wire protecting member 90 is bent while the cover body contactable portion 1052 is caused to be held in contact with or face the cover body 1010 as shown in FIG. 17. In this way, the rearward extending state of the rear cover 1050 is released.

At this time, a load acting with a contact point P1002 between the rear end of the cover body 1010 and the wire protecting member 90 as a point of force is generated in the cover body 1010. Then, a locked state of second locking portions 1040 is released earlier than that of first locking portions 1030. In this way, the detachment of the cover body 1010 from the connector 100 can be prevented.

If the wire protecting member 90 inside the rear cover 1050 is bent a large amount and a load received from the wire protecting member 90 by the rear cover 1050 exceeds a locking force of the extending shape holding portions 1060, the rear cover 1050 is divided into the rear cover halved portions 1050U and 1050D. In this way, the interference of the rear cover 1050 with the bent wire protecting member 90 can be prevented.

According to the related embodiment, as in the above embodiment, work efficiency in connecting the connector can be improved and the detachment of the cover body 1010 from the connector 100 can be prevented. However, since the rear cover halved portions 1050U, 1050D are not coupled to the cover body 1010 in the case of the related embodiment, the rear covers halved portions 1050U, 1050D are detached from the connector 100. Further, since a resilient restoring force of a coupling does not act on one of the rear cover halved portions 1050U, 1050D, the extending shape holding portions 1060 are less easily unlocked than in the above embodiment.

LIST OF REFERENCE SIGNS

1: connector cover
10: cover body
50: rear cover

60: extending shape holding portion
70: coupling
80: wire
100: connector

What is claimed is:

1. A connector cover for protecting a wire extending rearward from a connector, comprising:

a cover body mountable to extend rearwardly of the connector and fixed to the connector;

a rear cover disposed behind the cover body, the rear cover including at least two portions facing each other in directions normal to a forward to rearward direction, and an extending shape holding portion comprising an extension maintaining piece formed on one of the at least two portions and an extension maintaining projection formed on another of the at least two portions, the extension maintaining piece engaged with the extension maintaining projection to maintain the rear cover in a rearward extending state in which the at least two portions are connected and extend in the forward to rearward direction; and a coupling coupling the rear cover and the cover body; wherein the extending shape holding portion is configured so that a contact force of the wire on one of the at least two portions in response to lateral movement of the wire is greater than an unlocking force between the extension maintaining piece and the extension maintaining projection.

2. The connector cover of claim 1, wherein:

the cover body includes a lock to be locked to the connector with a predetermined locking force; and a holding force of the extending shape holding portion to hold the rear cover in the rearward extending state is set smaller than a pressing force of the wire to press the rear cover and the predetermined locking force is set larger than a load generated in the lock by the pressing force.

3. The connector cover of claim 1, wherein the rear cover, in response to contact between the wire and one of the at least two portions, transitions from the rearward extending state to a rearward extension release state in which the at least two portions are unlocked from each other and at least one of the at least two portions extends in a direction transverse to the forward to backward direction.

4. The connector of claim 1, wherein the coupling is a flexible coupling having a front end fixed to the cover body and a rear end fixed to the rear cover.

5. The connector of claim 4, wherein the coupling comprises first and second coupling pieces spaced apart in a direction transverse to the forward to rearward direction.

6. The connector of claim 5, wherein the first coupling piece is coupled to one of the at least two portions of the rear cover and the second coupling piece is coupled to another of the at least two portions.

* * * * *